US006739314B1

(12) United States Patent
Bauerle et al.

(10) Patent No.: US 6,739,314 B1
(45) Date of Patent: May 25, 2004

(54) DISPLACEMENT ON DEMAND WITH THROTTLE PRELOAD SECURITY METHODOLOGY

(75) Inventors: Paul A. Bauerle, Fenton, MI (US); Allen B. Rayl, Waterford, MI (US); Donovan L. Dibble, Utica, MI (US); Kerfegar K. Katrak, Fenton, MI (US); Kevin J. Storch, Brighton, MI (US); Alfred E. Spitza, Jr., Brighton, MI (US); Robert C. Simon, Jr., Novi, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/368,895

(22) Filed: Feb. 18, 2003

(51) Int. Cl.[7] ..... F02D 9/00

(52) U.S. Cl. ..... 123/396; 123/399; 123/198 F; 123/481

(58) Field of Search ..... 123/396, 399, 123/395, 481, 198 F

(56) References Cited

U.S. PATENT DOCUMENTS 4,469,071 A * 9/1984 Bassi et al. ..... 123/481
6,125,812 A * 10/2000 Garabedian ..... 123/198 F
6,619,267 B1 * 9/2003 Pao ..... 123/481

* cited by examiner

*Primary Examiner*—Bibhu Mohanty
(74) *Attorney, Agent, or Firm*—Christopher DeVries

(57) ABSTRACT

An engine control system and method monitors torque increase during cylinder deactivation for a displacement on demand engine. A timer is started at cylinder deactivation. A controller adjusts throttle position and determines whether cylinder deactivation completes within a predetermined time. The controller adjusts throttle position based on the status of an enable condition. The controller determines if engine speed and vehicle acceleration are each within a threshold. The controller operates the throttle in a preload operating mode if the enable condition is met and operates the throttle in a normal operating mode if the enable condition is not met.

10 Claims, 8 Drawing Sheets

DISPLACEMENT ON DEMAND WITH THROTTLE PRELOAD SECURITY METHODOLOGY

FIELD OF THE INVENTION

The present invention relates to engine control systems, and more particularly to throttle preload verification in displacement on demand engine control systems.

BACKGROUND OF THE INVENTION

Some internal combustion engines include engine control systems that deactivate cylinders under low load situations. For example, an eight cylinder can be operated using four cylinders. Cylinder deactivation improves fuel economy by reducing pumping losses. To smoothly transition between activated and deactivated modes, the internal combustion engine should produce torque with a minimum of disturbances. Otherwise, the transition will not be transparent to the driver. Excess torque causes engine surge and insufficient torque causes engine sag, both of which degrade the driving experience.

For an eight-cylinder engine, intake manifold pressure is significantly lower during eight-cylinder operation than during four-cylinder operation. During the transition from eight to four cylinders, there is a noticeable torque reduction or sagging in four-cylinder operation until the intake manifold reaches a proper manifold pressure level. In other words, there is less engine torque when cylinders are deactivated than when the cylinders are activated for the same accelerator position. The driver of the vehicle would be required to manually modulate the accelerator to provide compensation for the torque reduction and to smooth torque.

In commonly-owned U.S. Ser. No. 10/150,879 filed May 17, 2002 and entitled "Spark Retard Control During Cylinder Transitions in a Displacement On Demand Engine", which is hereby incorporated by reference, the throttle limit is adjusted to an increased position prior to cylinder deactivation to provide compensation. The increased throttle position or preload is accompanied by spark retard to offset torque increase caused by the preload before the cylinders are deactivated.

SUMMARY OF THE INVENTION

An engine control system and method monitors torque increase during cylinder deactivation for a displacement on demand engine. A timer starts at the initiation of cylinder deactivation. A controller communicates with the timer and adjusts the throttle position. The controller further determines whether cylinder deactivation completes within a predetermined time.

In other features, the controller increases throttle position from a normal operating position to an increased operating position when the timer starts. The controller maintains a deactivated throttle position if cylinder deactivation completes within the predetermined time. The controller returns the throttle to the normal operating position if cylinder deactivation exceeds the predetermined time.

A control system and method according to the invention monitors torque increase during cylinder deactivation for a displacement on demand engine. The control system includes a throttle and controller. The controller performs throttle preload and determines if torque increase exists during the throttle preload. The controller cancels the throttle preload if torque increase is detected.

In other features, torque increase is identified when an engine speed derivative exceeds an engine speed threshold, if a sample vehicle acceleration exceeds a vehicle acceleration threshold, if spark advance exceeds a spark advance threshold, and/or if an RPM derivative exceeds a predicted RPM derivative.

A method according to the invention monitors torque increase during cylinder deactivation for a displacement on demand engine. Operating cylinders are deactivated in the displacement on demand engine. Throttle area is increased to the displacement on demand engine from a predetermined area to an increased area. The method determines if cylinder deactivation occurred within a predetermined time. Air delivery is controlled based on cylinder deactivation occurring within the predetermined time by one of; returning to the predetermined area if the cylinder deactivation lasts beyond the predetermined time and maintaining a deactivated throttle area between the predetermined area and the increased area if the cylinder deactivation completes within the predetermined time.

A method for initiating deactivation for cylinders in a displacement on demand engine delivers fuel at a predetermined rate to the displacement on demand engine based on a throttle position. The method determines if a plurality of enable conditions are satisfied. The method performs one of increasing the throttle position and maintaining the throttle position based on the plurality of enable conditions.

In other features, the method further includes maintaining a constant accelerator pedal position. The step of determining includes determining if fuel is shut off to the cylinders of the displacement on demand engine, determining if a higher throttle position is requested and/or determining whether torque increase was detected during a throttle increase event.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
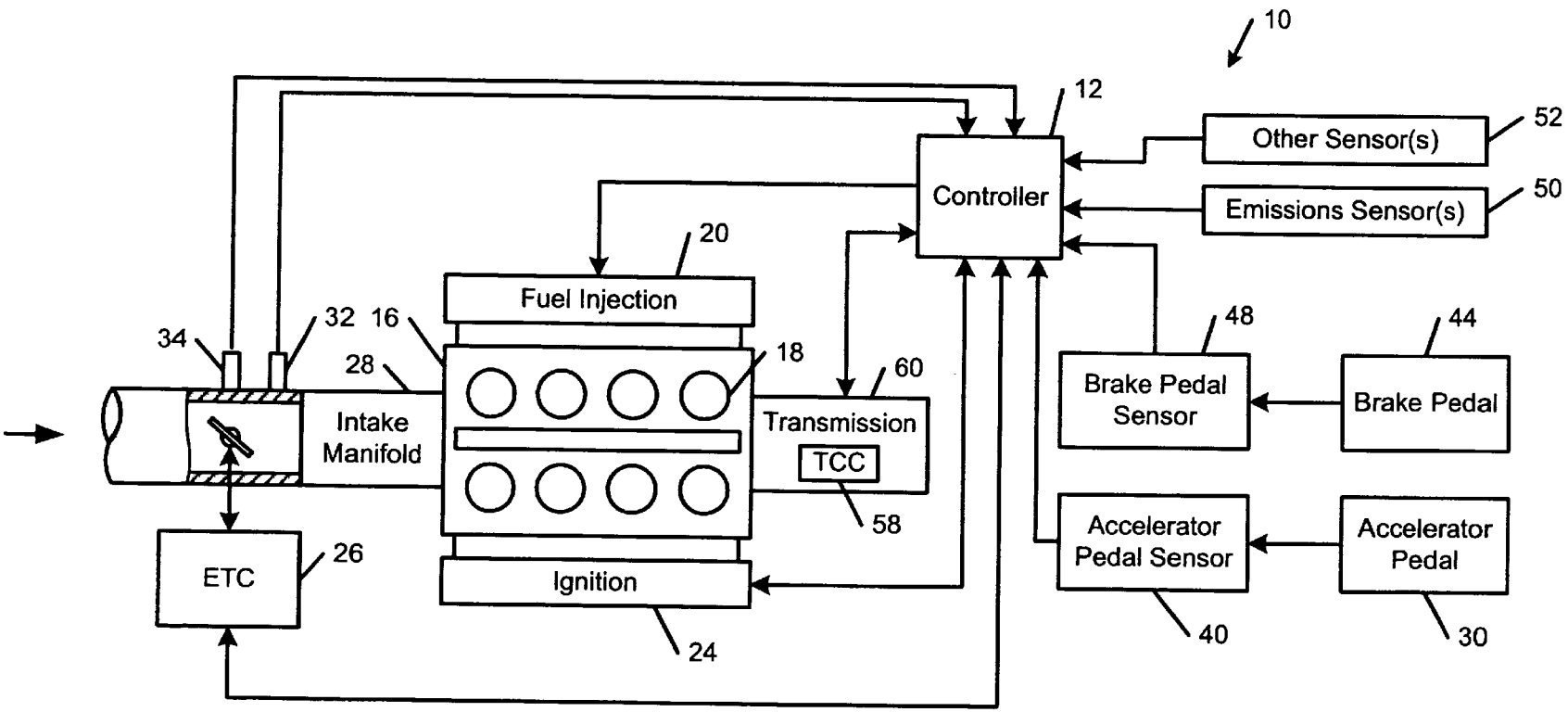
FIG. 1 is a functional block diagram of an engine control system that controls spark retard during cylinder deactivation according to the present invention.

The following description of the preferred embodiment(s) is merely exemplary in nature and is in no way intended to limit the invention, its application, or uses. For purposes of clarity, the same reference numbers will be used in the drawings to identify similar elements.

As used herein, activated refers to engine operation using all of the engine cylinders. Deactivated refers to engine operation using less than all of the cylinders of the engine (one or more cylinders not active). Furthermore, the exemplary implementation describes an eight cylinder engine with cylinder deactivation to four cylinders. However, skilled artisans will appreciate that the disclosure herein applies to cylinder deactivation in engines having additional or fewer cylinders such as 4, 6, 10, 12 and 16.

Referring now to FIG. 1, an engine control system 10 according to the present invention includes a controller 12 and an engine 16. The engine 16 includes a plurality of cylinders 18 each with one or more intake valves and/or exhaust valves (not shown). The engine 16 further includes a fuel injection system 20 and an ignition system 24. An electronic throttle controller (ETC) 26 adjusts a throttle area in an intake manifold 28 based upon a position of an accelerator pedal 30 and a throttle control algorithm that is executed by the controller 12. It will be appreciated that ETC 26 and controller 12 may include one or more controllers. One or more sensors 32 and 34 such as a manifold pressure sensor and/or a manifold air temperature sensor sense pressure and/or air temperature in the intake manifold 20.

A position of the accelerator pedal 30 is sensed by an accelerator pedal sensor 40, which generates a pedal position signal that is output to the controller 12. A position of a brake pedal 44 is sensed by a brake pedal sensor 48, which generates a brake pedal position signal that is output to the controller 12. Emissions system sensors 50 and other sensors 52 such as a temperature sensor, a barometric pressure sensor, and other conventional sensor and/or controller signals are used by the controller 12 to control the engine 16. An output of the engine 16 is coupled by a torque converter clutch 58 and a transmission 60 to front and/or rear wheels.

Figure 2:
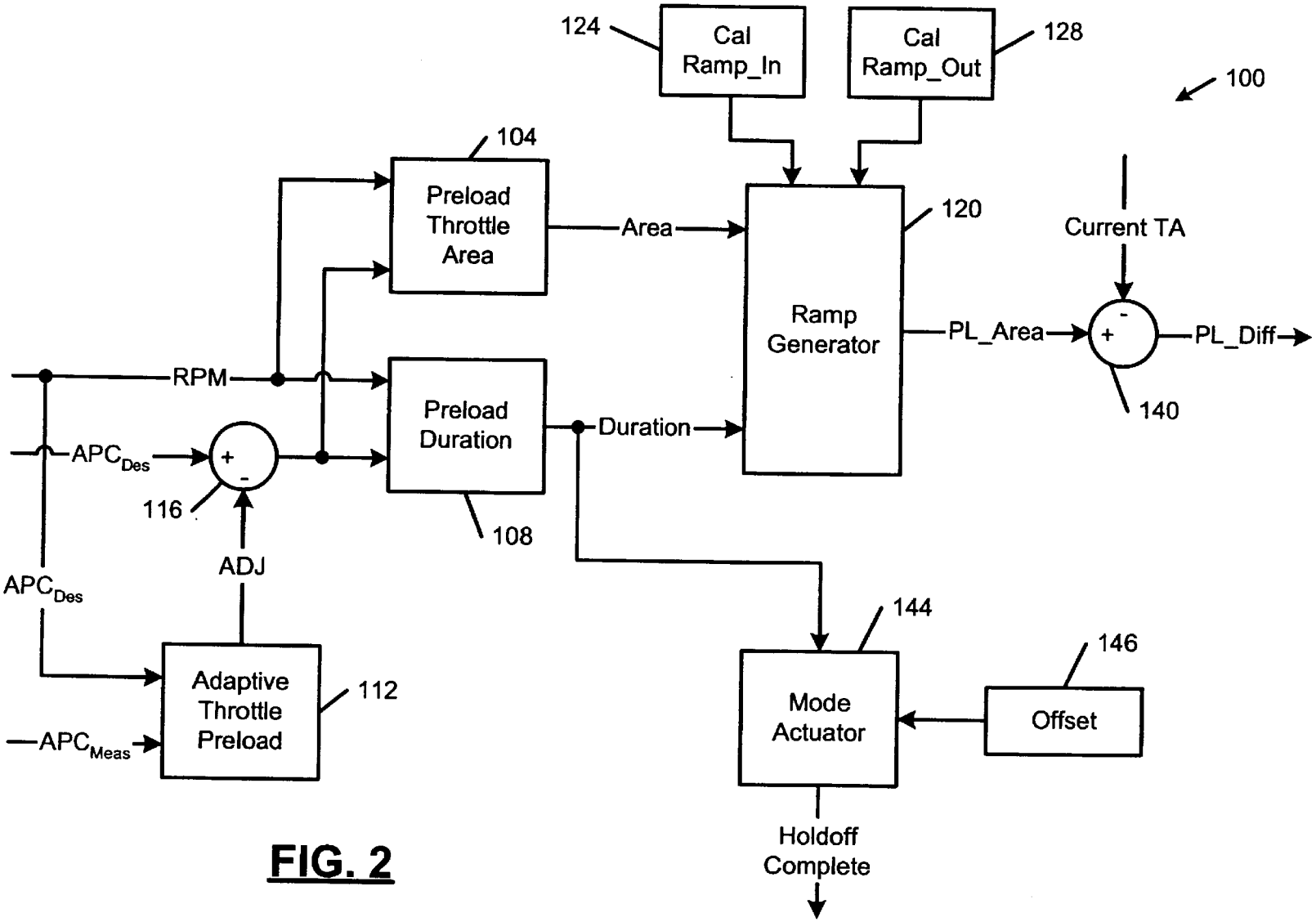
FIG. 2 is a functional block diagram of an exemplary throttle preload signal generator.

Referring now to FIG. 2, an exemplary preload signal generator 100 is shown. While a specific throttle preload signal generator will be described, other throttle preload generators may be used. The preload signal generator 100 adjusts throttle area before and during the transition from activated mode to deactivated mode to smooth the torque output of the engine 16. A throttle preload area generator 104 generates a throttle area signal based on a desired airflow per cylinder in deactivated mode ($APC_{Des}$) and engine rpm. The throttle preload area generator 104 can include a lookup table (LUT), a model or any other suitable circuit or software that generates the throttle preload area signal. The $APC_{Des}$ and engine rpm signals are also input to a preload duration generator 108, which generates a base duration or base period for the throttle preload. The preload duration generator 108 can also include a LUT, a model, or any other suitable circuit that generates the preload duration signal.

In an alternate embodiment, the $APC_{Des}$ and the measured airflow per cylinder ($APC_{Meas}$) signals are initially input to an adaptive throttle preload adjuster 112, which outputs an adjustment signal. The adaptive throttle preload adjuster 112 adjusts for variation in altitude, temperature and vehicle-to-vehicle variations. The adjustment (ADJ) is input to an inverting input of a summer 116. The $APC_{Des}$ is input to a noninverting input of the summer 116. The summer 116 outputs an adjusted desired airflow per cylinder ($APC_{Des_adj}$), which is input to the preload throttle area generator 104 and the preload duration generator 108. The engine rpm signal is input to the preload throttle area generator 104 and the preload duration generator 108.

The preload area signal that is output by the preload throttle area generator 104 and the duration signal that is output by the preload duration generator 108 are input to a ramp generator 120. Additional inputs to the ramp generator optionally include a ramp in calibration circuit 124 and a ramp out calibration circuit 128. The ramp in calibration circuit 124 specifies a ramp in period. Preferably, a gain applied during the ramp in period increases linearly from 0 to 1. Likewise, the ramp out calibration circuit 124 specifies a ramp out period. Preferably, a gain applied during the ramp out period decreases linearly from 1 to 0. Skilled artisans will appreciate, however, that nonlinear curves or other waveform shapes may be employed during the ramp in and ramp out periods to improve torque smoothing and to prevent throttle noise.

The ramp generator 120 generates a preload area (PL_area) signal that is output to a noninverting input of a summer 140. A current throttle area is input to an inverting input of the summer 140. An output of the summer 140 generates a preload difference or preload delta that is used to adjust the throttle area during cylinder deactivation transitions.

The duration signal is also input to a mode actuator 144. An offset circuit 146 generates a negative offset. The mode actuator 144 generates a hold off complete signal that is used to flag completion of a transition from activated to deactivated modes. The offset is preferably a negative offset from an end of the base duration. Alternately, the offset can be calculated from the beginning of the base duration or from other suitable signals.

Figure 3:
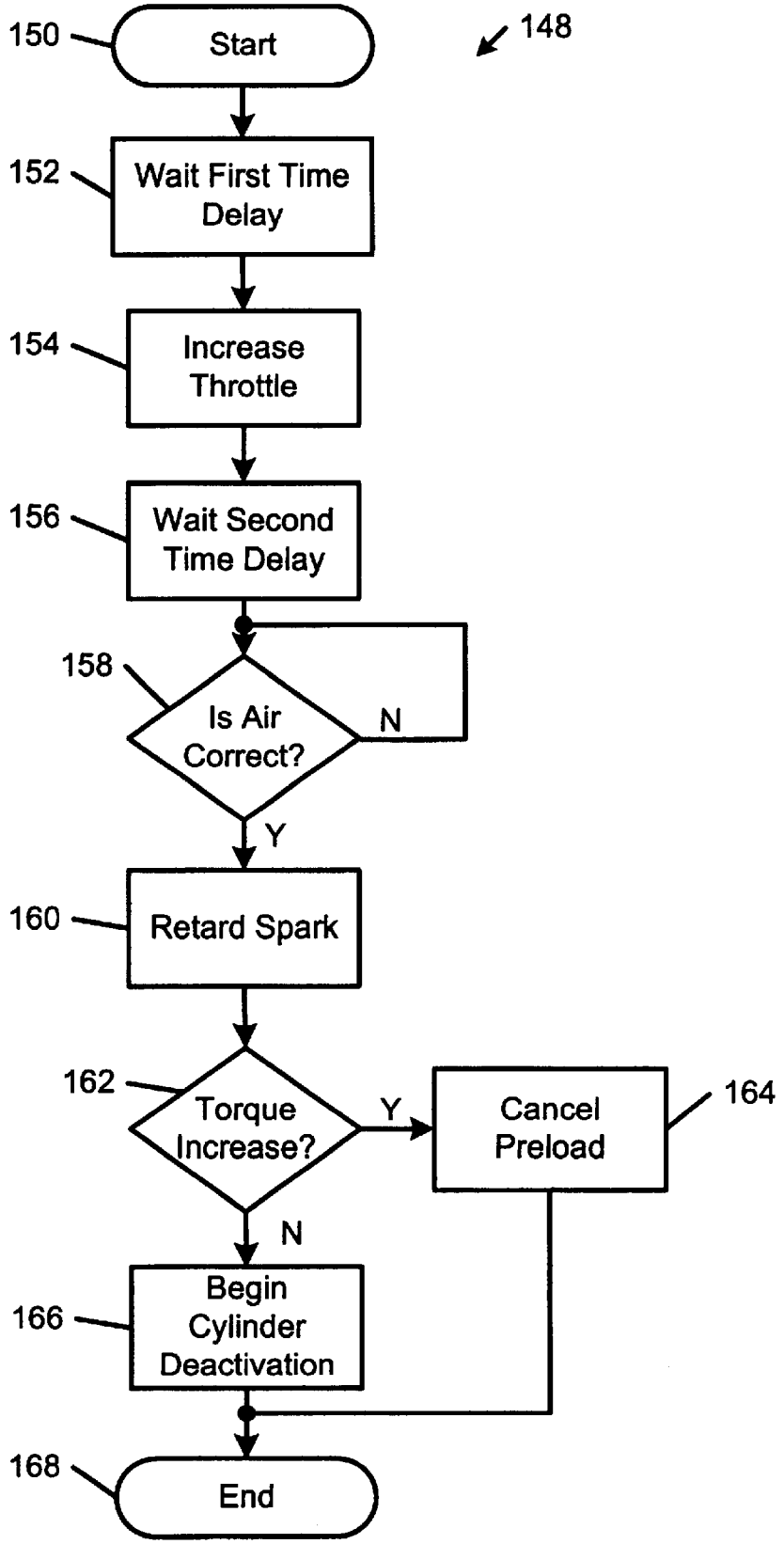
FIG. 3 is a flowchart illustrating steps of a preload security check according to the present invention.

With reference to FIG. 3, steps of a preload security check 148 that are performed by the controller 12 are illustrated. Security check 148 begins with step 150. In step 152, control optionally waits a first predetermined time delay such as but not limited to less than 1 second for hardware reaction time. In step 154, throttle is increased according to the calculated preload difference output at the summer 140. A second time delay at step 156 allows time for airflow to reach the manifold 28. The desired air received at the manifold 28 is compared to measured air at the manifold 28 in step 158. If the measured air is within a threshold, control retards spark in step 160. If the air measured is not within a threshold, control loops to step 158.

Torque increase is monitored in step 162. Torque increase is preferably determined by the following methods. Those skilled in the art will recognize, however, that torque increase may also be determined in other ways. A first exemplary approach determines whether a derivative of engine revolutions per minute (RPM) exceeds an engine speed threshold. The derivative is calculated from a change in RPM measured on the engine crankshaft over a predetermined time. The RPM is preferably measured over a sufficient period to compensate for tooth to tooth error on the crankshaft. If the measured value is greater than the engine speed threshold, torque increase is detected.

An alternative approach for detecting torque increase compares current vehicle acceleration with an acceleration threshold. If the current acceleration exceeds the acceleration threshold, torque increase exists. In yet another approach, spark advance is measured. The individual spark outputs requested by controller 12 are compared with the actual measured spark output at cylinders 18. If the measured spark exceeds the requested spark by a spark advance threshold, torque increase exists.

A final exemplary approach stores an RPM derivative at the start of preload and compares a current RPM derivative to the saved derivative. If the current RPM derivative exceeds the saved RPM derivative, torque increase exists. This approach assumes that the rate of change of RPM does not increase during a transition to cylinder deactivation.

If torque increase exists, preload is cancelled at step 164 and control loops to step 168. If torque increase does not exist, cylinder deactivation begins in step 166. Control ends in step 168.

Figure 4:
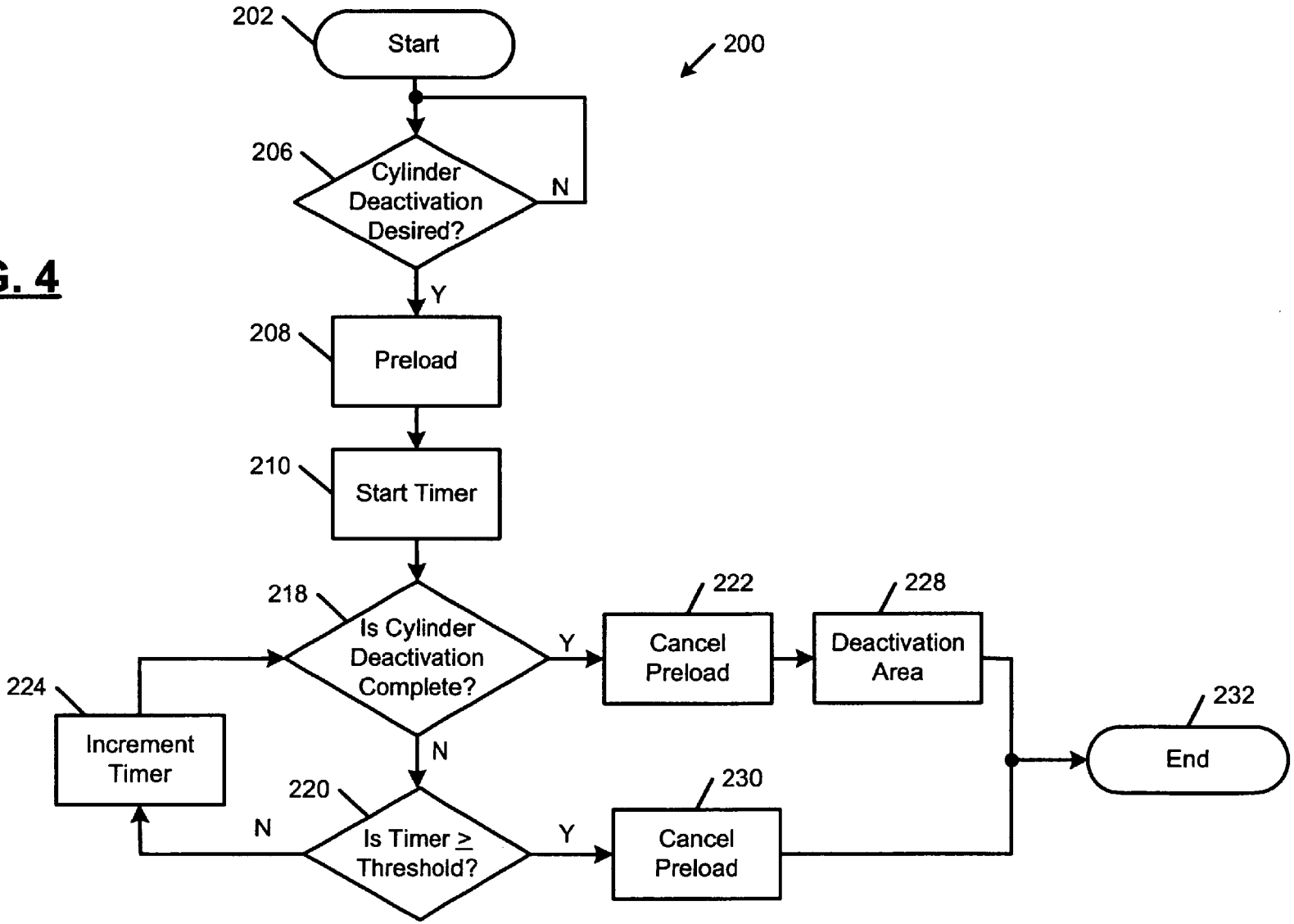
FIG. 4 is a flowchart illustrating steps of a timeout check according to the present invention that verifies the integrity of a cylinder deactivation event.
Figure 7:
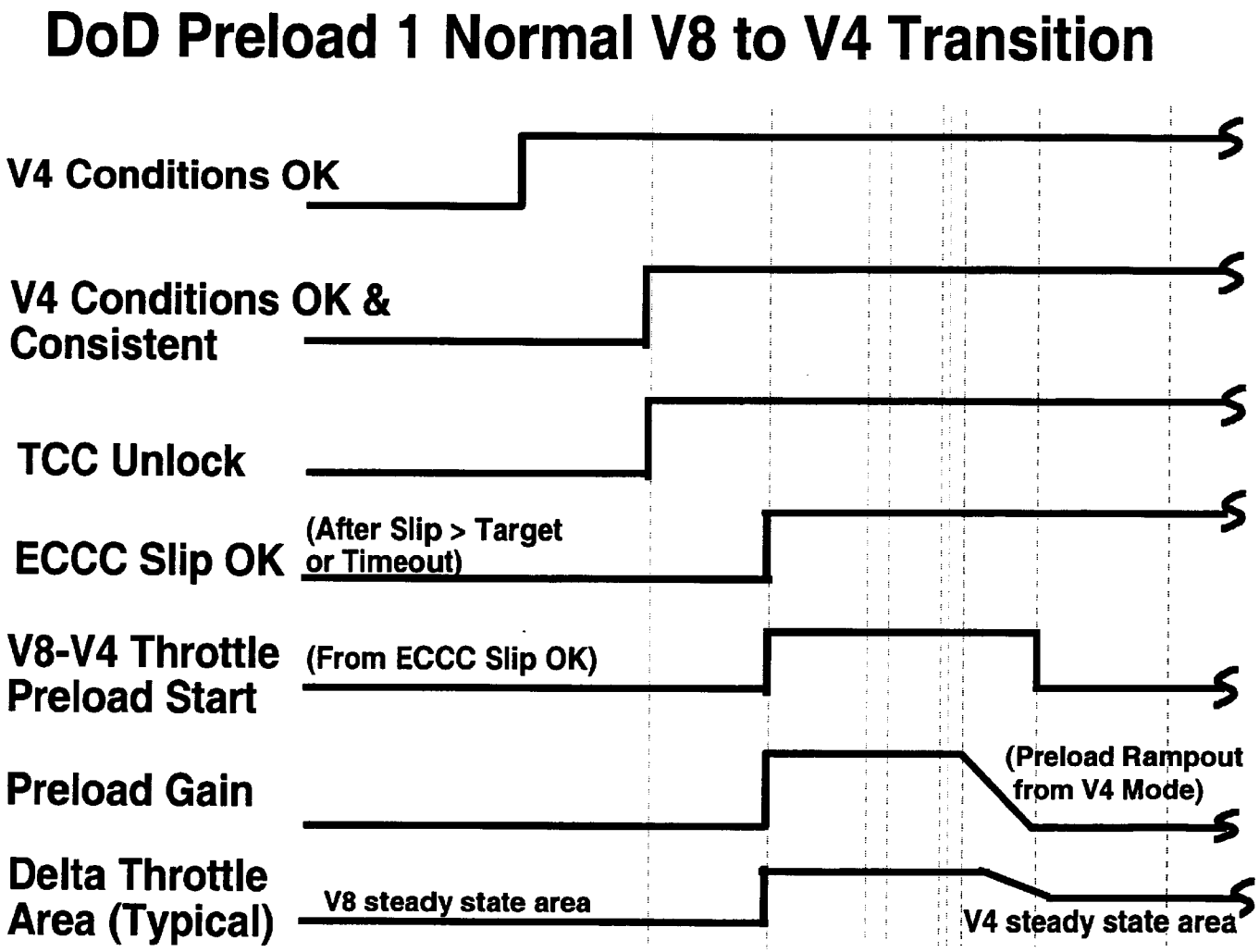
FIG. 7 illustrates exemplary control signals for the throttle preload signal generator.

Turning now to FIGS. 4 and 7, a timeout method 200 is shown and is implemented during a cylinder deactivation event. For example, in an eight-cylinder engine, if four cylinders have not deactivated in the desired time, the engine will be operating on between eight and five cylinders. Accordingly, it is not necessary to provide throttle preload because a torque increase is not required. If cylinder deactivation is successful within the predetermined time, it is desirable to cancel preload and reduce throttle area to a deactivated throttle area to provide a seamless transition to four operating cylinders. Deactivated throttle area is an intermediate throttle area maintained when the engine is operating in the deactivated mode. The deactivated throttle area is maintained between a normal operating condition and a preload operating condition (see Delta Throttle Area, FIG. 7).

The timeout method 200 is conducted after preload initiation to monitor the transition between activated and deactivated conditions. Control begins with step 202. In step 206, the controller 12 determines if cylinder deactivation is enabled. If not, control loops to step 206. If cylinder deactivation is desired, preload is initiated in step 208. Once preload is initiated, a timer is started in step 210. In step 218, control determines whether cylinder deactivation is complete. If not, control determines whether the timer has exceeded a predetermined time threshold in step 220.

Preferably, the predetermined time threshold is set below 1 second. 0.2 seconds is suitable, although other time thresholds may be employed. If the timer has not exceeded the predetermined threshold, the timer is incremented in step 224 and control returns to step 218. If the timer has exceeded the threshold, preload is cancelled in step 230 and control ends in step 232. If cylinder deactivation is complete in step 218, preload is cancelled in step 222 and deactivation area is maintained in step 228 and control ends in step 232.

Figure 5A:
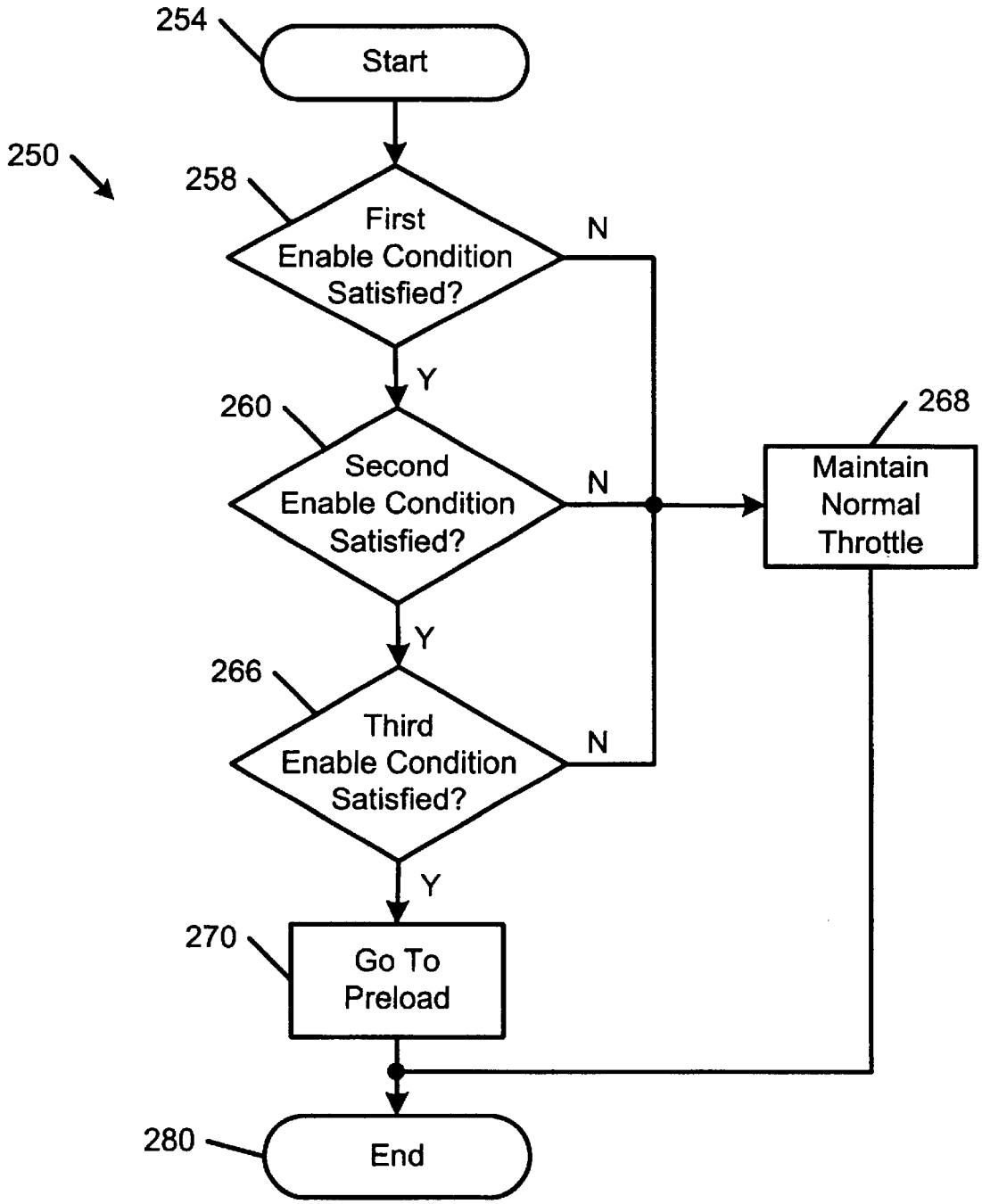
FIG. 5A is a flowchart illustrating steps of a security check according to the present invention that monitors a status of predetermined enable conditions identifying a start of cylinder deactivation.

Referring now to FIGS. 1 and 5A, a throttle increase security method 250 according to the present invention is shown. Security method 250 implements a check to assure that one or more enable conditions are satisfied prior to increasing throttle for preload. Controller 12 includes logic that monitors the status of a plurality of enable conditions for redundancy. While the exemplary embodiment includes preferred enable conditions that must be satisfied to continue with throttle preload, other enable conditions may be employed.

The security method 250 starts with step 254. The method 250 consecutively checks if first, second and third enable conditions are satisfied in steps 258, 260 and 266 respectively. If each condition is satisfied, preload is initiated in step 270. If one condition is false, normal throttle is maintained in step 268. Control ends at step 280. Although method 250 implements three enable checks, an alternate number of checks may be implemented.

Figure 5B:
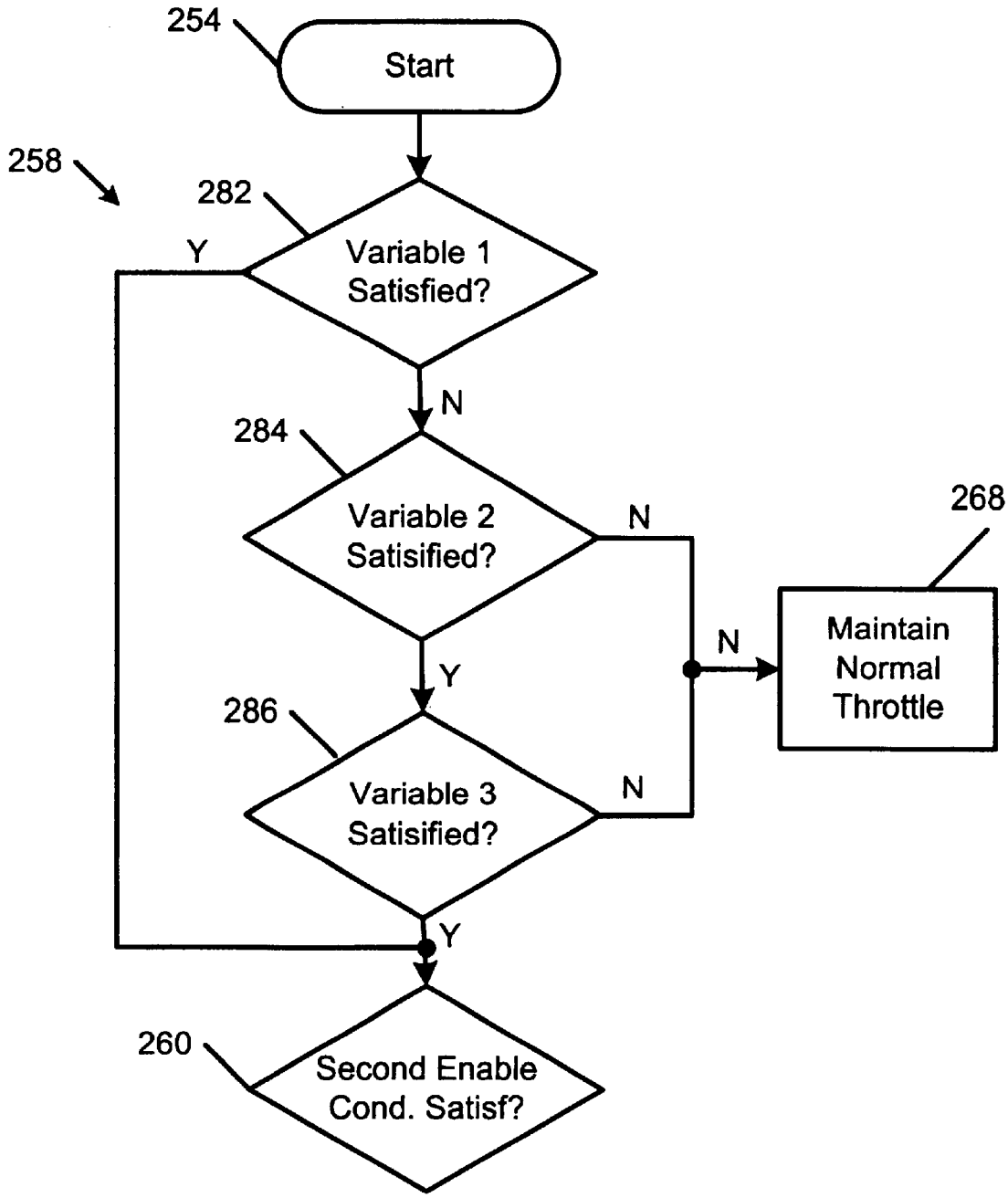
FIG. 5B is a flowchart illustrating a first enable condition of FIG. 5A.

The enable conditions will now be described in greater detail. Referring now to FIGS. 1, 5A and 5B, the first enable condition in step 258 is described in greater detail. In step 282, control determines if FuelOffEnbl is set to true. FuelOffEnbl is a flag that is used to indicate whether fuel is shut off to half of the cylinders or the timer has not exceeded a threshold (step 220 in FIG. 4). If FuelOffEnbl is true, control proceeds to step 260. If false, control determines whether CD_State is set to preload in step 284. If CD_State is set to preload, the controller 12 determines whether ETC_Disables_Pre_load is set to true in step 286. If CD_State is not set to preload, control continues with step 268. ETC_Disables_Pre_Load is set to true when an increase in engine torque is detected during preload. If ETC_Disables_Pre_Load is true, control maintains normal throttle in step 268. If ETC_Disables_Pre_Load is set to false, control loops to step 260.

Returning now to FIG. 5A, a second enable condition is checked in step 260. In step 260, control determines whether CD_State is not set to active mode. If CD_State is not set to active mode, the controller 12 is in the process of deactivating cylinders or has deactivated cylinders and control continues in step 266. If CD_State is set to active mode, control proceeds to step 268.

In step 266, the third enable condition is checked. In step 266, control determines whether Gear_State is set to a predetermined gear. For example, the Gear_State can be set to a gear equal to or greater than 3. If control determines that the third enable condition is not satisfied in step 266, normal throttle is maintained in step 268. If the third enable condition is satisfied, control continues with preload in step 270. Control ends at step 280.

Figure 6:
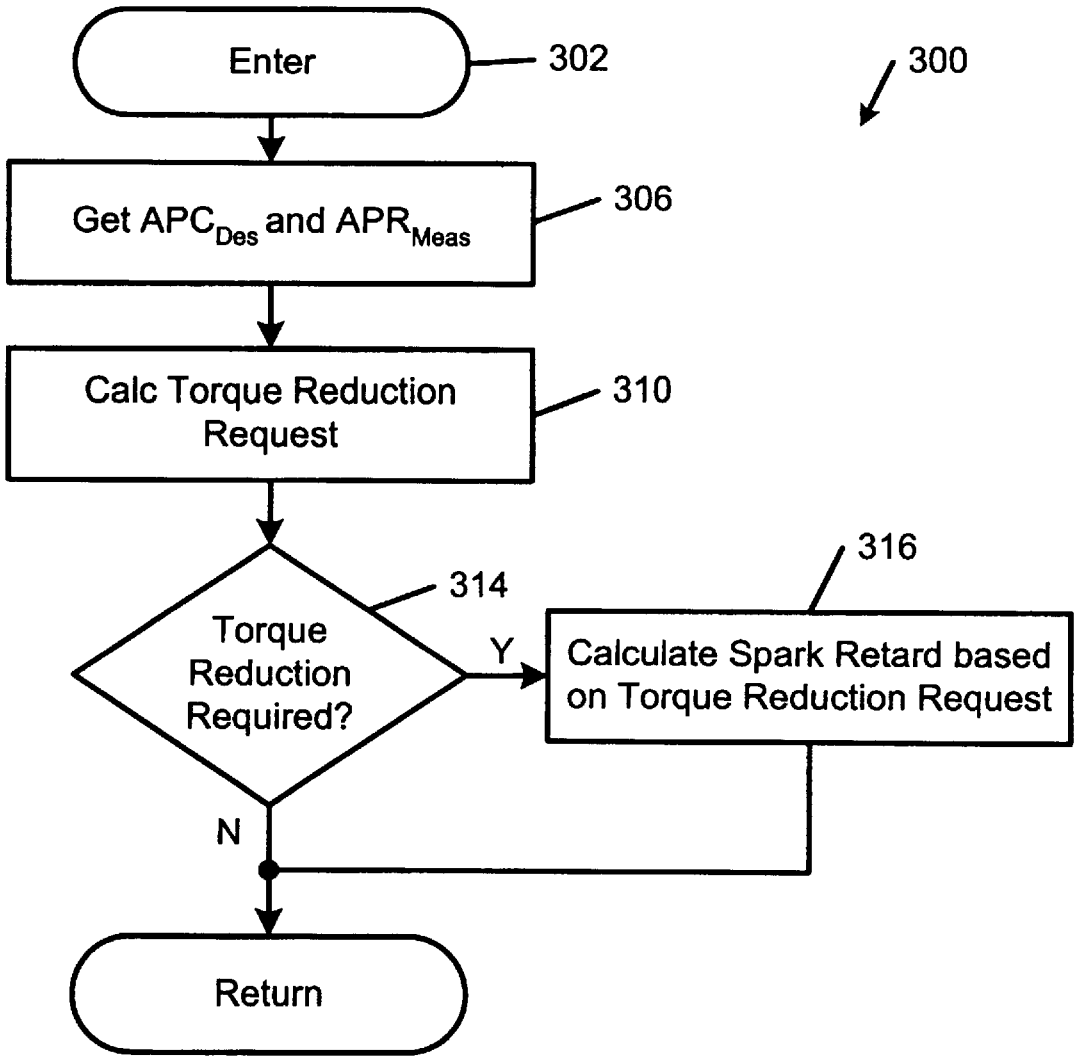
FIG. 6 is a flowchart illustrating exemplary steps for retarding spark.

Referring now to FIG. 6, steps for retarding spark are shown generally at 300. Control begins with step 302. In step 306, $APC_{Des}$ and $APC_{Meas}$ are retrieved. A torque reduction request is calculated in step 310. In step 314, the controller 12 determines whether a torque reduction is required. If true, a spark retard request is calculated in step 316 based on a torque reduction request. Control returns from steps 314 and 316. The spark retard steps that are shown generally at 300 are preferably executed for each cylinder firing event.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An engine control system for monitoring torque increase during cylinder deactivation for a displacement on demand engine, comprising:

a timer started at cylinder deactivation; and a controller that communicates with said timer, that adjusts throttle position and that determines whether cylinder deactivation completes within a predetermined time.

2. The engine control system of claim 1 wherein said controller increases throttle position from a normal operating position to an increased operating position when said timer starts.

3. The engine control system of claim 2 wherein said controller maintains a deactivated throttle position if cylinder deactivation completes within said predetermined time.

4. The engine control system of claim 2 wherein said controller returns said throttle to said normal operating position if cylinder deactivation exceeds said predetermined time.

5. The engine control system of claim 1 wherein said controller cancels a throttle preload if a torque increase is detected.

6. The engine control system of claim 5 wherein said torque increase is detected if an engine speed derivative exceeds an engine speed threshold.

7. The engine control system of claim 5 wherein said torque increase is detected if vehicle acceleration exceeds a vehicle acceleration threshold.

8. The engine control system of claim 5 wherein said torque increase is detected if spark advance exceeds a spark advance threshold.

9. The engine control system of claim 5 wherein said enable condition is met if engine RPM exceeds a predicted engine RPM.

10. A method for monitoring cylinder deactivation for a displacement on demand engine, comprising:

providing an engine control system for monitoring a torque increase during cylinder deactivation for said displacement on demand engine;

providing a timer started at cylinder deactivation;

deactivating operating cylinders in said displacement on demand engine;

increasing throttle area to said displacement on demand engine from a predetermined area to an increased area;

determining if cylinder deactivation occurred within a predetermined time generated by said timer; and controlling air delivery based on said cylinder deactivation occurring within said predetermined time by one of:

(A) returning to said predetermined area if said cylinder deactivation lasts beyond said predetermined time; and (B) maintaining a deactivated throttle area between said predetermined area and said increased area if said cylinder deactivation completes within said predetermined time.

* * * * *